US011396981B2

(12) United States Patent
Dufour et al.

(10) Patent No.: US 11,396,981 B2
(45) Date of Patent: Jul. 26, 2022

(54) SCALABLE BACKFEEDING INSTALLATION AND METHOD

(71) Applicant: GRTGAZ, Bois Colombes (FR)

(72) Inventors: Daniel Dufour, Bois Colombes (FR); Frédéric Vulovic, Bois Colombes (FR); Christophe Pardieu, Bois Colombes (FR)

( * ) Notice: Subject to any disclaimer, the term of this patent is extended or adjusted under 35 U.S.C. 154(b) by 0 days.

(21) Appl. No.: 17/252,307

(22) PCT Filed: Jun. 17, 2019

(86) PCT No.: PCT/FR2019/051468

§ 371 (c)(1),
(2) Date: Dec. 15, 2020

(87) PCT Pub. No.: WO2019/239081

PCT Pub. Date: Dec. 19, 2019

(65) Prior Publication Data

US 2021/0270425 A1 Sep. 2, 2021

(30) Foreign Application Priority Data

Jun. 15, 2018 (FR) ..... 1855294

(51) Int. Cl.
*F17D 1/07* (2006.01)
*F17D 3/01* (2006.01)
*F17D 1/04* (2006.01)

(52) U.S. Cl.
CPC ..... *F17D 3/01* (2013.01); *F17D 1/04* (2013.01); *F17D 1/07* (2013.01)

(58) Field of Classification Search
CPC ..... F17D 3/01; F17D 1/04; F17D 1/07
(Continued)

(56) References Cited

U.S. PATENT DOCUMENTS 4,478,246 A * 10/1984 Sherrod ..... F17D 1/04 137/557
7,624,770 B2 * 12/2009 Boyd ..... F17C 5/007 141/11

(Continued)

FOREIGN PATENT DOCUMENTS

DE 10 2009 038 128 * 2/2011 ..... F17D 1/02
DE 10 2009 038128 A1 2/2011

(Continued)

OTHER PUBLICATIONS

ISR; European Patent Office; NL; dated Nov. 5, 2019.

(Continued)

*Primary Examiner* — Minh Q Le
(74) *Attorney, Agent, or Firm* — Patshegen IP LLC; Moshe Pinchas

(57) ABSTRACT

The invention relates to a backfeeding installation (30) which comprises:

- at least one stationary compressor (21) between a gas network (15) at a first pressure and a gas network (10) at a second pressure higher than the first pressure, and
- an automaton (33) for controlling the operation of each stationary compressor.

The backfeeding installation also comprises:

- a distribution unit (31) for distributing gas from the gas network at the first pressure to each stationary compressor and to the gas inlet connector at the first pressure for at least one additional compressor (29, 45, 46); and
- a collection unit (32) for collecting gas from each stationary compressor and the gas outlet connector at the second pressure for each additional compressor.

The automaton is configured to control the operation of each stationary compressor and of each additional compressor as (Continued)

a function of the compression capacity of the operational stationary and additional compressors.

11 Claims, 6 Drawing Sheets

(58) Field of Classification Search
USPC ..... 137/2, 259, 899.4, 565.17, 14; 141/11, 141/98; 62/50.6
See application file for complete search history.

(56) References Cited

U.S. PATENT DOCUMENTS

| | | | | |
|---|---|---|---|---|
| 2009/0000302 | A1* | 1/2009 | Edwards | F17D 1/04 60/698 |
| 2013/0030577 | A1* | 1/2013 | Jarrell | G01M 3/24 700/282 |
| 2013/0233388 | A1* | 9/2013 | Utal | F17C 13/083 137/1 |
| 2015/0020918 | A1* | 1/2015 | Macaluso | F17C 7/00 141/11 |
| 2015/0240996 | A1 | 8/2015 | Kapoor | |
| 2018/0073684 | A1* | 3/2018 | Ikeda | F17C 13/04 |
| 2020/0188624 | A1* | 6/2020 | Nelson Mock | A61M 16/104 |
| 2020/0254383 | A1* | 8/2020 | Roodbeen | B01D 53/226 |
| 2020/0355325 | A1* | 11/2020 | Mann | F17C 3/08 |
| 2021/0054837 | A1* | 2/2021 | Robbins | F04B 39/02 |

FOREIGN PATENT DOCUMENTS

| | | | | |
|---|---|---|---|---|
| FR | 3001523 | * | 1/2013 | F17D 3/01 |
| FR | 2007417 | * | 6/2013 | C10L 3/10 |
| FR | 3 001 523 | A1 | 8/2014 | |
| FR | 3 007 417 | A1 | 12/2014 | |
| FR | 3035598 | * | 4/2015 | B01D 53/30 |
| FR | 3 035 598 | A1 | 11/2016 | |

OTHER PUBLICATIONS

"IFI Capacity Enhancement Project MP to IP Network Compression"; Winnard; Oct. 17, 2012.
"The Power Pioneers Bio-Natural Gas Plant Emmertsbuh Feeding Biogas into the Natural Gas Grid Emmertsbuhl" Darocha; Apr. 27, 2012.

* cited by examiner

SCALABLE BACKFEEDING INSTALLATION AND METHOD

TECHNICAL FIELD

The present invention relates to a scalable backfeeding installation and method. It applies, in particular, to gas transport networks for exporting oversupplies of renewable natural gas from a distribution network to a transport network, which has a much larger storage capacity.

STATE OF THE ART

Biogas production is growing rapidly in Europe. The added value it brings underpins the creation of a sustainable anaerobic digestion industry. Hereinafter, the term "biomethane" means the gas produced from the raw biogas obtained from the anaerobic digestion of organic waste (biomass) or by high-temperature gasification (followed by methanation synthesis), which is then cleaned and treated so that it becomes interchangeable with the natural gas of the network.

While the most common method of adding value is the generation of heat and/or electricity, its utilization as a fuel and the injection of biomethane into the natural gas network are also being developed.

The injection of biomethane into the natural gas network is already taking place in Europe. Against a background of the rapid development of biomethane, the natural gas distributors are faced with situations in which there is a shortage of outlets. This is because consumption by domestic customers over the public distribution systems varies on average from 1 to 10 between winter and summer. The injection of biomethane is initially possible only if it is done at a flow rate less than the minimum flow rate recorded during the periods of lowest consumption, or if the biomethane is produced as close as possible to where it is consumed. When production exceeds the quantities consumed, this tends to saturate the distribution networks during warm seasons. This situation limits the development of the biomethane production industry through the congestion of the natural gas distribution networks. Several solutions have been identified to solve this problem: the interconnection of distribution networks to increase the consumption capacities for the biomethane produced by increasing the number of consumers connected; adjusting biomethane production according to the seasons and consumption needs; microliquefaction and compression for storing biomethane production during periods of low consumption; the development of uses for the gas (in particular, for mobility); and the production of backfeeding units between the natural gas distribution and transport networks.

Backfeeding installations are therefore one of the solutions identified for developing biomethane injection capacities. These installations make it possible to export oversupplies of biomethane from a distribution network to the transport network, by compressing and reinjecting them into this transport network to benefit from its much larger gas storage capacity. Consequently, the producers would no longer have to limit their production and the profitability of their projects would be guaranteed more easily. The backfeeding unit is a structure of the transport operator that allows gas to be transferred from the distribution network to the transport network having a larger storage capacity, via a gas compression station. The backfeeding unit can be located either in the vicinity of the pressure reducing station or at another location where the transport and distribution networks cross.

Backfeeding therefore includes a function of compressing the gas to adapt it to the constraints imposed by the downstream of this compressor, i.e. the transport network. Current backfeeding units are stationary installations in which the compressors are placed inside buildings. There, each compressor is driven by an electric motor connected to the electricity grid.

For financial reasons, some backfeeding units are equipped with only one compressor ensuring 100% of the flow rate. Consequently, these backfeeding units do not ensure a normal operation if the single compressor fails. But the installation of a second compressor ensuring 100% of the flow rate, to provide backup if a stationary backfeeding unit fails, is a costly solution.

In addition, distribution network configurations evolve, especially when a biogas supplier connects to it and injects biogas into it, or disconnects from it. At the same time, gas consumption in this distribution network can increase or decrease, for example when a consuming factory or large store is installed or when it stops. Therefore, the backfeeding unit can have excess or insufficient capacity, either momentarily or permanently.

More generally, the existing backfeeding installations do not allow their sizing to evolve in line with need.

DESCRIPTION OF THE INVENTION

The present invention aims to remedy all or part of these drawbacks.

To this end, according to a first aspect, the present invention relates to a backfeeding installation comprising:

- at least one stationary compressor between a gas network at a first pressure and a gas network at a second pressure higher than the first pressure; and
- an automaton for controlling the operation of each stationary compressor;

the installation also comprising:

- a mounting space for at least one additional compressor, which space is equipped with at least one gas inlet connector at the first pressure, at least one gas outlet connector at the second pressure, and at least one energy supply connector for the additional compressor;
- a distribution unit for distributing gas from the gas network at the first pressure to each stationary compressor and to the gas inlet connector at the first pressure for at least one additional compressor; and
- a collection unit for collecting gas from each stationary compressor and the gas outlet connector at the second pressure for each additional compressor, the automaton being configured to detect the operational stationary and additional compressors, to determine the compression capacity of the operational compressors and to control the operation of each stationary compressor and each additional compressor as a function of the compression capacity of the operational stationary and additional compressors.

Thanks to these provisions, the compression capacities of the backfeeding installation can evolve easily. An additional compressor can be easily installed in this installation by connecting it to the distribution unit, the collection unit, the control automaton. Similarly, an additional compressor can be easily removed from the installation by carrying out the reverse operations.

In some embodiments, the mounting space for at least one additional compressor is configured to accommodate a vehicle containing at least one additional compressor, the installation being configured so that the vehicle has driving access from outside the installation to the mounting space.

Thanks to these provisions, the evolution of the backfeeding installation is easy and can be momentary, simply by parking a vehicle containing the backfeeding unit in the mounting space and connecting this compressor to the gas inlet and outlet connectors and to an energy source.

In some embodiments, the backfeeding installation also comprises a recycling circuit equipped with a valve, configured to expand the gas exiting from at least one compressor and inject it upstream from or into the distribution unit when at least one compressor is put into operation, the automaton being configured to control the operation of the valve of the recycling circuit as a function of the compression capacity of the operational stationary and additional compressors that are put into operation jointly.

Thanks to these provisions, the stability of the distribution network is ensured, regardless of the operational compression capacity of the compressors put into operation jointly, i.e. simultaneously or with a reduced time lag.

In some embodiments, at least one additional compressor is mobile.

Thanks to these provisions, during a temporary increase in the compression needs of the backfeeding installation (breakdown or short-term overcapacity of the biogas producers, short-term reduction in consumption by gas consumers), the mobile additional compressor is added to the backfeeding installation. Then it is removed once this temporary increase ceases.

In some embodiments, at least one additional compressor is incorporated into a standard container.

In some embodiments, at least one additional compressor is mounted on a vehicle.

Thanks to each of these provisions, transporting the compressor is made easier.

In some embodiments, at least one additional compressor is actuated mechanically by a motor of the vehicle.

In some embodiments, at least one additional compressor is supplied with electrical power by a generator mounted on the vehicle.

Thanks to each of these provisions, the actuation of the compressor requires no oversizing of the power supply of the backfeeding installation, relative to the supply for stationary compressors on their own.

In some embodiments, the energy supply connector of the additional compressor supplies gas at the first pressure to a motor or to an electricity generator of a vehicle.

Thanks to these provisions, the vehicle can continually actuate the additional compressor that it transports.

In some embodiments, the lines and electrical power supplies are sized for the simultaneous operation of each stationary compressor and of each additional compressor.

Thanks to these provisions, the backfeeding installation can accommodate each additional compressor without the compressor having to be associated with a power supply and/or additional lines.

According to a second aspect, the present invention relates to a scalable method for a backfeeding installation comprising:

- at least one stationary compressor between a gas network at a first pressure and a gas network at a second pressure higher than the first pressure;
- an automaton for controlling the operation of each stationary compressor;
- a mounting space for at least one additional compressor, which space is equipped with at least one gas inlet connector at the first pressure, at least one gas outlet connector at the second pressure, and at least one energy supply connector for the additional compressor;
- a distribution unit for distributing gas from the gas network at the first pressure to each stationary compressor and to the gas inlet connector at the first pressure for at least one additional compressor; and
- a collection unit for collecting gas from each stationary compressor and the gas outlet connector at the second pressure for each additional compressor, said method comprising a step of automatically detecting operational stationary and additional compressors, a step of determining the compression capacity of the operational compressors, and a step of controlling the operation of each stationary compressor and each additional compressor as a function of the compression capacity.

As the particular features, advantages and aims of this method are similar to those of the installation that is the subject of the invention, they are not repeated here.

BRIEF DESCRIPTION OF THE FIGURES

Other advantages, aims and characteristics of the present invention will become apparent from the description that will follow, made, as an example that is in no way limiting, with reference to the drawings included in an appendix, wherein.

DESCRIPTION OF EMBODIMENTS OF THE INVENTION

Figure 1:
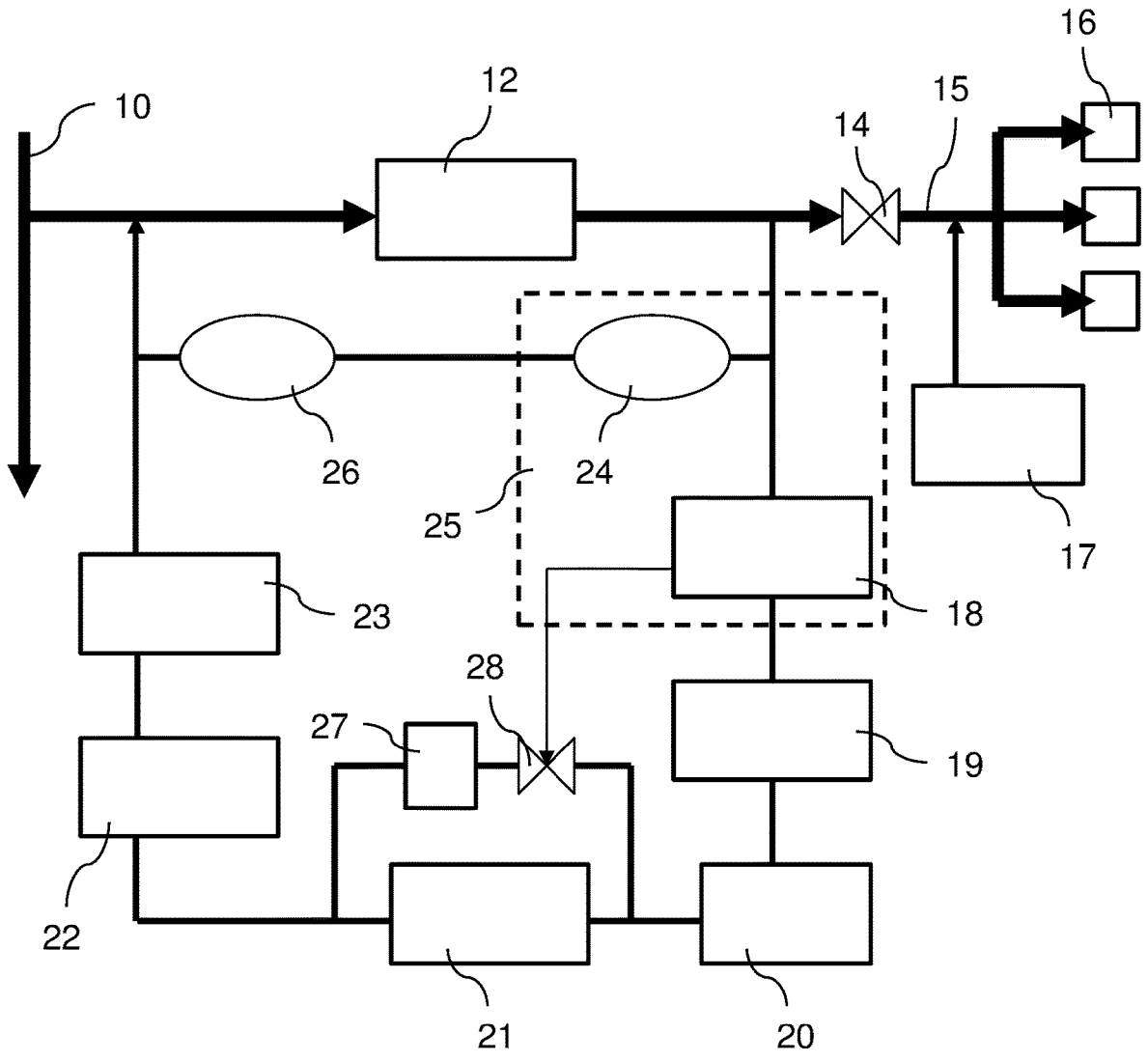
FIG. 1 represents, in the form of a block diagram, a backfeeding installation known in the prior art.

FIG. 1 represents, schematically, the principle of a backfeeding installation known in the prior art. The backfeeding installation has a set of technical functions making it possible to create a flow of gas by controlling the operating conditions specific to a transport network 10 and a distribution network 15. These functions comprise:

- processing and verifying 19 the quality compliance of the gas with the technical specifications of the transport operator;
- metering 20 the quantities transferred;

compressing the gas from the distribution network 15, by at least one compressor 21, this consists generally of electrically-driven or piston compressors, with two or three compression stages;

regulating 24 the pressure or flow rate;

filtering 22, upstream and downstream;

managing 18 the stability of the operation of the distribution network;

the safety devices 26; and the tools 24 for managing and monitoring the backfeeding installation.

These various functions are described below. In addition, there are the utilities (electrical sources, communication network, etc.) necessary to operate an industrial facility. The backfeeding installation is sized taking into account:

the operating pressure of the transport network 10 and of the distribution network 15. The first must be between 30 and 60 bar over the regional network, and can reach 85 bar over the main network. The second is 4 to 19 bar over the MPC networks (Medium Pressure Network type C, i.e. pressure between 4 and 25 bar) and less than 4 bar over the MPB networks (Medium Pressure Network type B, i.e. pressure between 50 millibar and 4 bar);

the maximum production capacity of the biomethane producers 17 likely to inject biomethane into the distribution network 15, a capacity that varies by several tens of $Nm^3/h$ for the smallest units, to several hundreds of $Nm^3/h$ for the largest;

the consumption of consumers 16 over the distribution network 15, especially the minimum consumption; and the ability of the distribution network 15 to absorb variations in pressure (water volume).

All of this data makes it possible to determine the maximum flow rate of the backfeeding installation and to estimate its operating time. This can vary, depending on the case, from an occasional operation (10-15% of the time) to an almost-permanent operation. This exercise must also include the fact that the installations of the producers 17 are put into service over the years, not simultaneously.

With regard to the analysis 19 of the gas conformity, differences exist between the gas quality specifications applied to the transport 10 and distribution 15 networks, because of the different operating pressures, infrastructure, materials, uses and interfaces with the underground storage sites. The specifications of the transport networks 10 are generally more stringent than those of the distribution networks 10. Therefore, to ensure that the gas backfeeding installation from the distribution network 15 to the transport network 10 is consistent with operations in the transport network 10, the following provisions are included in the gas quality compliance function 19:

a dehydration unit upstream of the compression to reduce the condensation risks on the high-pressure transport network, the formation of hydrates and corrosion, optionally, a laboratory for analyzing combustion parameters (Wobbe index, heating value and density of the gas), for injecting the samples in the energy determination system of the transport operator.

At the transport operator's discretion, the analysis of other levels of compounds ($CO_2$, $H_2O$, THT, etc.) is optional, and is only carried out if there is a proven risk of contamination of the transport network 10 (for example, backfeeding biomethane with a high $CO_2$ content with no possibility of dilution over the distribution 15 and transport 10 networks, or operation at a very high pressure).

For the gas metering 20, the backfeeding installation is equipped with a measurement chain made up of a meter and a local or regional device for determining the energy per the legal metrology.

With regard to the gas compression, the compression unit enables the surplus biomethane production to be compressed to the operating pressure of the transport network 10. There are several possible configurations, depending on the economic criteria and availabilities of the installation, such as:

one compressor 21 providing 100% of the maximum backfeeding need;

two compressors 21, each providing 100% of the maximum backfeeding need; or two compressors 21, each providing 50% of the maximum backfeeding need.

The configuration is chosen by examining the various advantages and drawbacks in terms of costs, availability, dimensions, and scalability of the compression unit. The suction pressure to be considered is the operating pressure of the distribution network 15, which depends in particular on the injection pressures of the biomethane producers 17. The discharge construction pressure to be considered is the maximum operating pressure ("MOP") of the transport network, for example 67.7 bar. To perform the starting phase, the anti-surge protection system of each compressor 21 (other than piston compressors) or the stabilized operation in recycling mode, a recycling circuit 27 equipped with a valve 28 can be provided. The recycling circuit expands the gas to the second pressure and injects it upstream from the compressor when at least one compressor is put into operation, under the control of the automaton 25.

The impermeability of each compressor 21 can be achieved with oil or dry packing. In the first case, certain filtering provisions are implemented (see below).

An automaton 25 performs the functions of management 24, control of each compressor, and regulation and stability 18 of the network 15. Note that, throughout the description, the term "automaton" means a PLC or computer system, or a set of PLCs and/or computer systems (for example one PLC per function).

With regard to regulation, the change in the pressure of the distribution network 15 in the vicinity of the backfeeding installation is correlated to the flow rate of the gas passing through the backfeeding installation. These changes are the result of the dynamic nature of gas consumption over the distribution network 15, capacities of biomethane injected by the producers 17 and the operation of the delivery installation, by means of a valve 14, and backfeeding installation. This therefore incorporates possibilities to adapt the operating range for the suction pressure of the backfeeding installation, and also a regulation of the compressors 21 that can anticipate the constraints operating over the distribution network 15, depending on the configurations encountered. This differs from delivery stations without backfeed, for which the pressure is regulated at the delivery point so as to be fixed, regardless of the consumption by the consumers 16. Consequently, the regulation mode (pressure or flow rate) of the backfeed flow towards the transport network 10 is adapted to the correct operation of the backfeeding installation.

Depending on the specifications of the compressors, and to prevent their deterioration or because of the constraints linked to the operation of the transport network 10, filtering is envisaged in the gas quality compliance function, upstream from the compression so as to collect any liquid and the dust contained in the gas from the distribution network 15. In addition, in the case of an oil-sealed compressor 21, a coalescing filter 22 is installed at the outlet from the compressor 21, for example with manual venting and a gauge glass.

A cooling system 23 cools all or part of the compressed gas to maintain the temperature downstream, towards the transport network 10, at a value below 55° C. (certification temperature of the equipment). To ensure the operation of the cooling system 23, it is sized using relevant ambient temperature values based on meteorological records.

The delivery station 12 is an installation, located at the downstream end of the transport network, which enables the natural gas to be delivered according to the needs expressed by the customer (pressure, flow rate, temperature, etc.). Therefore, this concerns the expansion interface for the gas from the transport network 10 to the distribution network 15 or to certain industrial installations. The delivery station 12 therefore incorporates expansion valves to reduce the pressure in order to adapt to the conditions imposed downstream.

To prevent instability phenomena, the backfeeding installation must not operate simultaneously with the expansion and delivery station 12 from the transport network 10 to the distribution network 15. Threshold values for the starting and stopping of the backfeeding installation are set accordingly, and each automaton 25 of an installation combining expansion 12 and backfeed is adapted to prohibit the simultaneous occurrence of these two functions. The backfeeding installations, during their starting, operation and stopping phases, limit the disruptions in the upstream network (distribution 15) and downstream network (transport 10) by, in particular, preventing the pressure safety measures of the delivery station 12 from being triggered. The following parameters are taken into account:

- number of starting and stopping cycles of each compressor 21 and its compatibility with the recommendations of the supplier of the compressor 21;
- the starting and stopping of each compressor 21 by a routine, following a time delay;
- the use of a buffer volume (not shown) upstream from each compressor 21, to level out pressure and flow rate variations of the distribution network 15.

A management and monitoring function performed by the automaton 25 makes it possible to obtain:

- an automatic operation mode;
- display/monitoring of the operation of the backfeeding installation; and
- the starting of the backfeeding installation.

Data historization is carried out to confirm the operating conditions.

In an emergency, the backfeeding installation is isolated from the distribution network 15 by closing the valve 14. An "emergency stop" function allows the backfeeding installation to be stopped and made safe. The backfeeding installation is also equipped with pressure and temperature safety devices 26. There is no automatic venting unless contraindicated in the safety studies. The backfeeding installation is equipped with gas and fire detection systems 26. A means for protection against excess flows is provided to protect the devices, in the form of a physical component such as a restrictor hole or by means of an automaton.

Note that the flow rate of a backfeeding unit can vary from several hundred to several thousand $Nm^3/h$, depending on the case.

Figure 2:
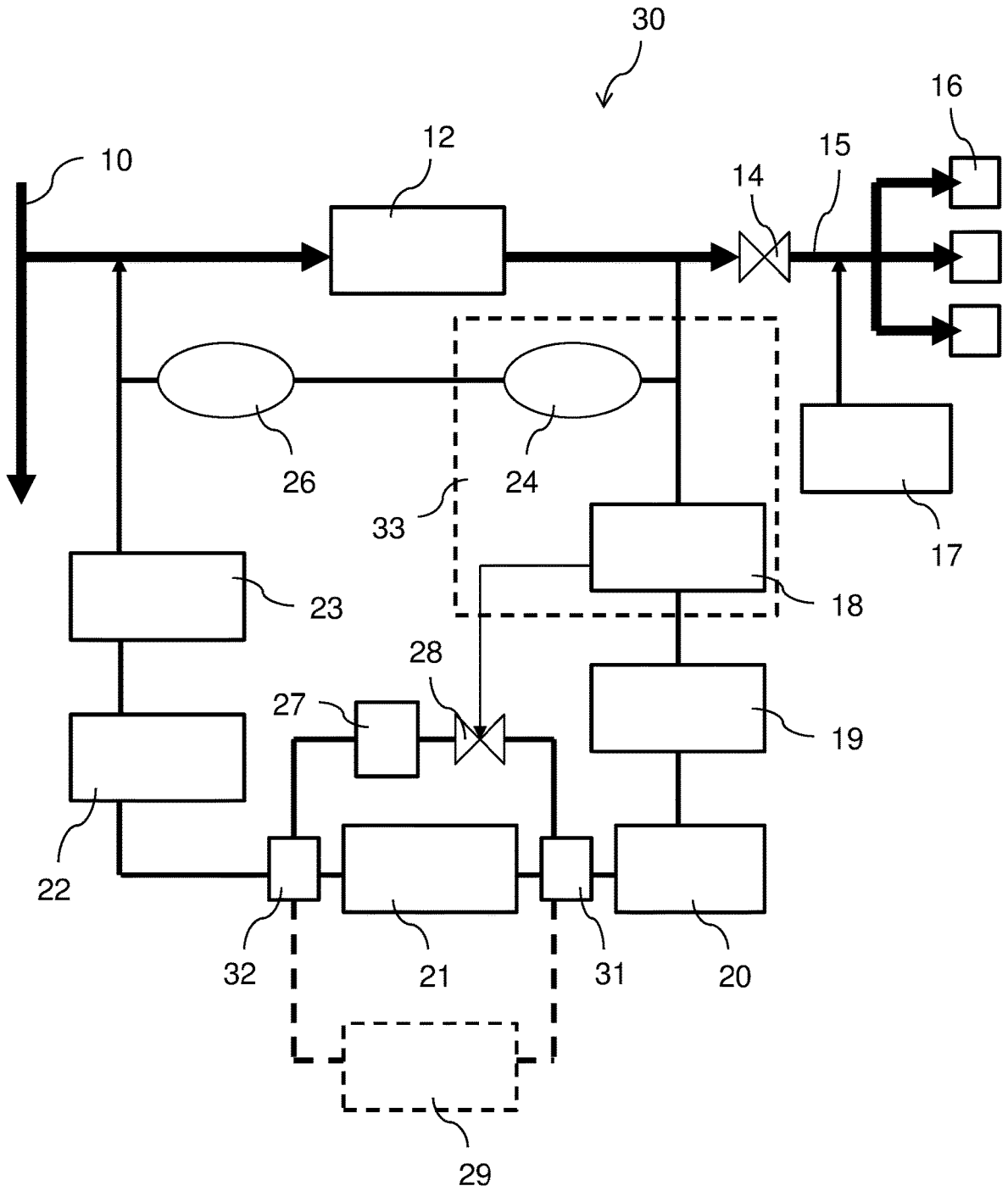
FIG. 2 represents, in the form of a block diagram, a backfeeding installation that is the subject of the invention.

FIG. 2 represents a particular embodiment of a scalable backfeeding installation 30 that is the subject of the invention. It includes the functions shown in FIG. 1, with the exception of the automaton 25, to which are added:

- a distribution unit 31 for distributing gas from the distribution network 15 to each stationary compressor 21 and to a first free interface, or connector, for at least one additional compressor 29; and
- a collection unit 32 for collecting the compressed gas from each stationary compressor 21 and a second free interface, or connector, for each additional compressor 29.

An automaton 33 is configured to control the operation of each stationary compressor 21 and each additional compressor 29 as a function of the compression capacity of the operational compressors.

Consequently, the capacities of the backfeeding installation 30 can evolve easily:

- an additional compressor 29 can be easily installed in this installation by connecting it to the free interfaces, or connectors, of the distribution unit 31 and the collection unit 32, and by connecting it to the control automaton 33;
- similarly, an additional compressor 29 can be easily removed from the backfeeding installation 30 by carrying out the reverse operations.

The automaton 33 is configured to control the operation of the valve 28 of the recycling circuit 27 as a function of the compression capacity of the operational stationary 21 compressors and operational additional 29 compressors that are put into operation jointly. In this way, the stability of the distribution network 15 is ensured, regardless of the operational compression capacity of the compressors 21 and 29 put into operation jointly.

Figure 3:
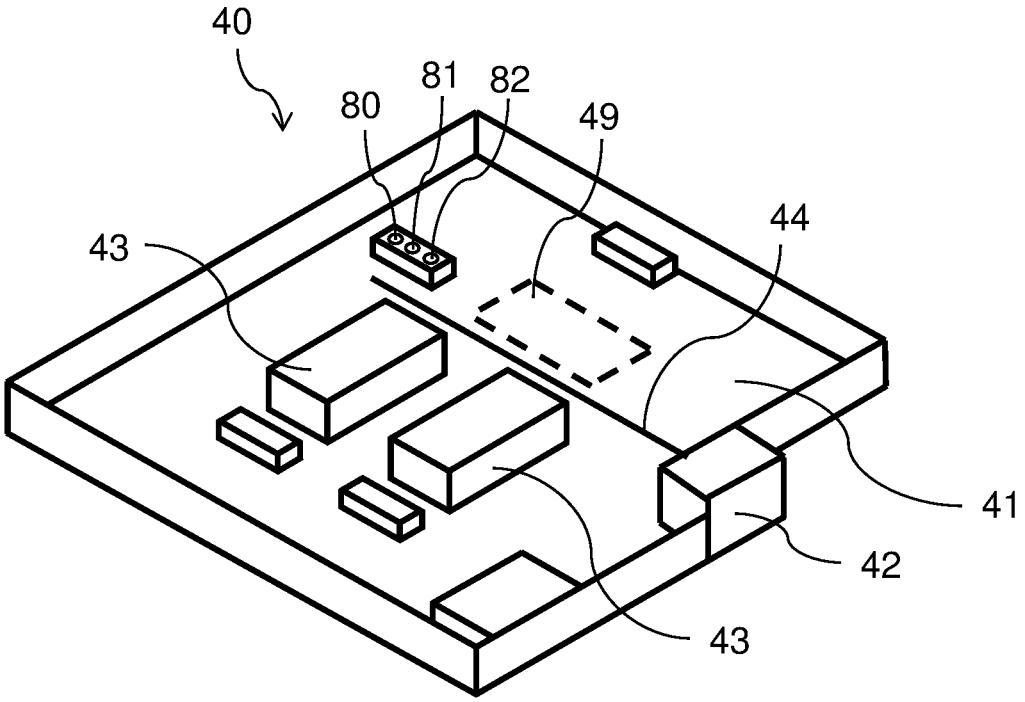
FIG. 3 represents, schematically, a particular embodiment of the backfeeding installation that is the subject of the invention, with no additional compressor.

FIG. 3 shows a backfeeding installation 40, which comprises a stationary portion in a building, in particular a slab 41 for supporting the various systems, a cabinet 42 comprising the automaton 33, at least one compressor 43, and a cable 44 for the electrical and computer connection of the various systems equipped with sensors and actuators (in particular valves).

In the embodiment shown in FIG. 3, the backfeeding installation 40 comprises at least one dedicated mounting space, or location, 49 for an additional compressor in the vicinity of a free interface of the distribution unit and in the vicinity of a free interface of the collection unit. The utilization of each additional compressor is therefore made easier.

The mounting space 49 is equipped with at least one gas inlet connector 80 at the first pressure, at least one gas outlet connector 81 at the second pressure, and at least one energy supply connector 82 (gas from the distribution network 15 or electricity) for each additional compressor 46. This connector 82 can supply an electric or combustion motor actuating the additional compressor 46 or a vehicle's generator with gas at the first pressure, this generator supplying an electric motor actuating the additional compressor 46.

The lines and electrical power supplies (not shown) are sized for the simultaneous operation of each stationary compressor 43 and of each additional compressor 46. In this way, the backfeeding installation 40 can accommodate each additional compressor without the compressor having to be associated with a power supply and/or additional lines.

Figure 4:
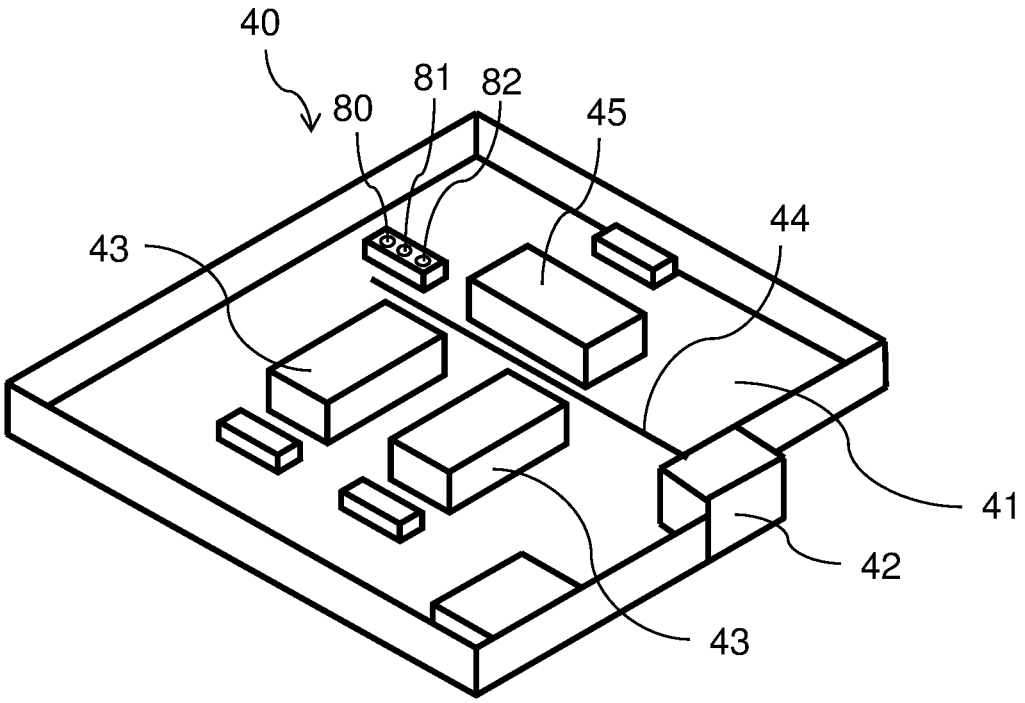
FIG. 4 represents, schematically, the backfeeding installation illustrated in FIG. 3, with a non-mobile additional compressor.

FIG. 4 shows the backfeeding installation 40 after connecting a non-mobile additional compressor 45.

Figure 5:
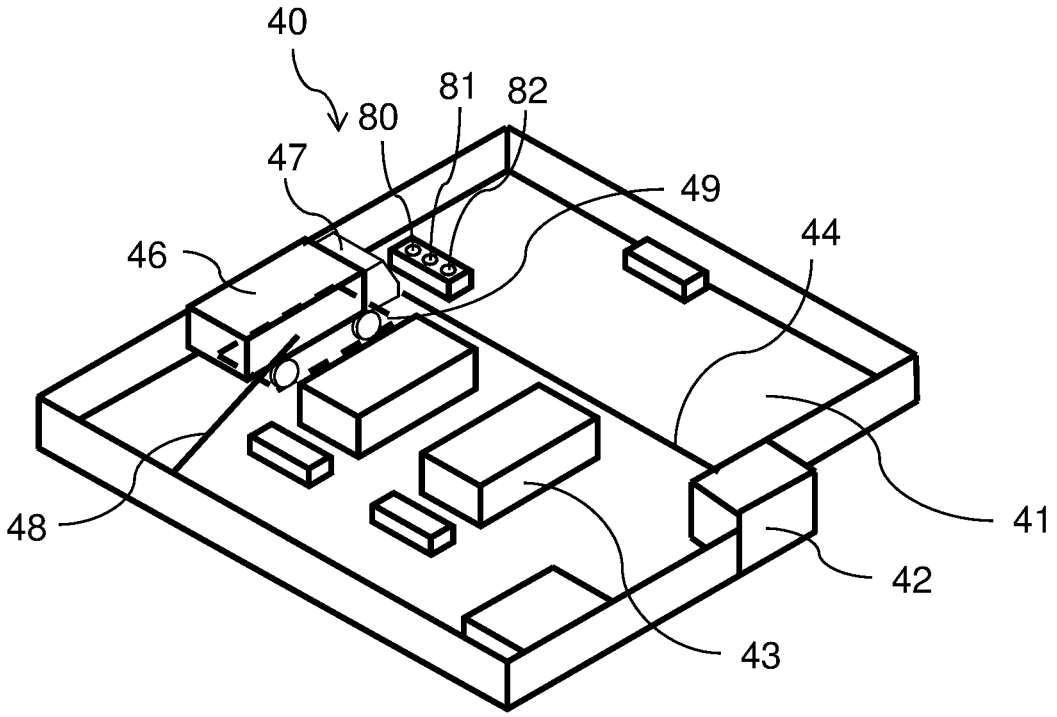
FIG. 5 represents, schematically, the backfeeding installation illustrated in FIG. 3, with a mobile additional compressor.

FIG. 5 shows the backfeeding installation 40 after connecting a mobile additional compressor 46 mounted on a vehicle 47 (in this case, a truck) and connected to the distribution network 15 by a connector 48.

Thanks to the mobility of the additional compressor 46, during a temporary increase in the compression needs of the backfeeding installation 40 (breakdown or short-term overcapacity of the biogas producers, short-term reduction in consumption by gas consumers), the mobile additional compressor 46 is added quickly and easily to the backfeeding installation 40. Then it is removed once this temporary increase ceases.

Because the additional compressor 46 is mounted on a vehicle 47 and preferably incorporated into a standard container, transporting the additional compressor 46 is made easier.

In some embodiments, the additional compressor 46 is actuated mechanically by a motor of the vehicle 47. To this end, a mechanical linkage, for example with universal joints, connects a shaft of the motor of the vehicle 47, for example its only motor, to a shaft of the compressor. Preferably, the motor actuating the additional compressor 46 is an electric motor or a gas motor using the gas from the line with the lowest pressure of the distribution network 15.

In some embodiments, at least one additional compressor 46 is supplied with electrical power by a generator mounted on the vehicle 47, preferably operating with gas from the lowest pressure channel of the distribution network 15. Therefore, actuation of the compressor 46 requires no oversizing of the energy supply of the backfeeding installation 40, relative to the supply for stationary compressors 43 on their own.

In the embodiment shown in FIGS. 3 to 5, the backfeeding installation 40 comprises:

- at least the stationary compressor 43 between the distribution network 15 of gas at a first pressure, and the transport network 10 of gas at the second pressure, and
- the mounting space 49 for at least one additional compressor, a space equipped with at least one gas inlet connector 80 at the first pressure, at least one gas outlet connector 81 at the second pressure, and, optionally, at least one energy supply connector 82 (gas from the distribution network 15 or electricity) of the additional compressor 46;
- the distribution unit 31 for distributing gas from the gas network at the first pressure to each stationary compressor and to the gas inlet connector at the first pressure for at least one additional compressor 45 and/or 46; and
- the collection unit 32 for collecting gas from each stationary compressor and the gas outlet connector at the second pressure for each additional compressor 45 and/or 46.

The automaton 33 for controlling the operation of each stationary compressor, and each additional compressor 46, is configured to detect the operational stationary and additional compressors, to determine the compression capacity of the operational compressors and control the operation of each stationary compressor and each additional compressor as a function of the compression capacity of the operational stationary and additional compressors.

In FIG. 5, the mounting space 49 for at least one additional compressor is configured to accommodate a vehicle containing at least one additional compressor. The installation 40 is configured so that the vehicle 47 has driving access from outside the installation to the mounting space 49.

Figure 6:
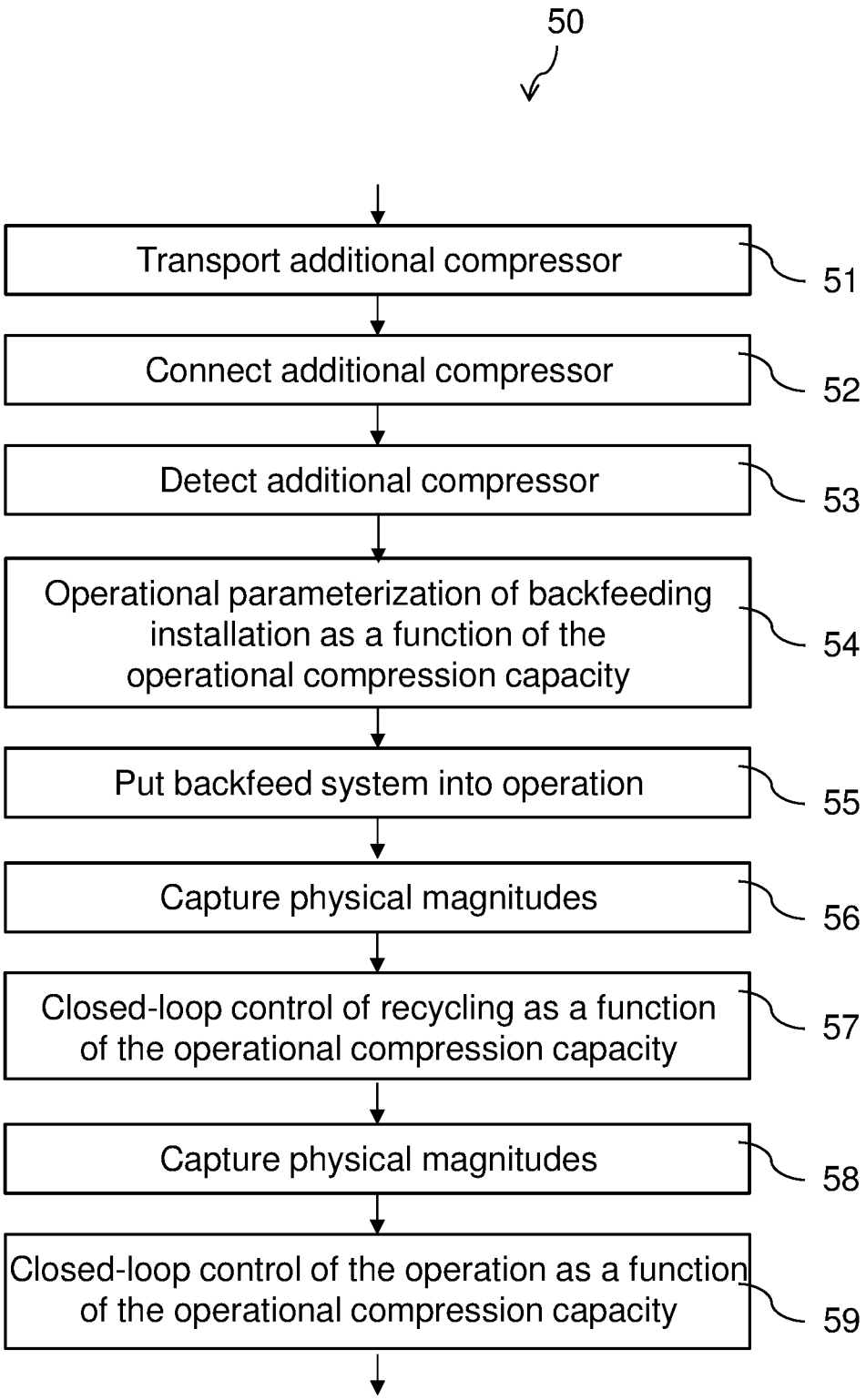
FIG. 6 represents, in the form of a logic diagram, steps in a particular embodiment of the method that is the subject of the present invention.

FIG. 6 shows steps of a scalable method for a backfeeding installation that is the subject of the invention.

During a step 51, an additional compressor is transported into the premises of the backfeeding installation. As described above, the additional compressor is preferably positioned in a dedicated location or a vehicle transporting it is positioned there.

During a step 52, the additional compressor is connected to the channels of the backfeeding installation, to the automaton and, if it is not energy self-sufficient, to the energy supply of the backfeeding installation.

During a step 53, the automaton automatically detects the presence of the additional compressor and its compression capacity. This detection can be automatic, for example by detecting the electrical link between the automaton and the motor of the compressor, or manual, with the installation of the compressor being declared by an operator on a user interface of the automaton.

During a step 54, the automaton determines the compression capacity of the operational compressors and defines the operational parameterization of the backfeeding installation as a function of the operational compression capacity (i.e. including the additional compressor but not taking into account compressors that have broken down or are stopped, e.g. for maintenance or update). The operational parameterization mainly consists of setting:

- threshold values for pressure and other physical magnitudes measured by sensors incorporated into the various devices present in the installation; and
- possibly, values of actuation parameters for valves and other devices, such as delay times or change curves.

During a step 55, the automaton orders the backfeeding installation to be put into operation.

During a step 56, the automaton receives physical magnitudes captured by the sensors of the backfeeding installation, in particular the pressure value at the inlet of each compressor.

During a step 57, the automaton carries out closed-loop control of the recycling circuit as a function of the operational compression capacity. The unitary or combined starting of compressors causes a pressure peak and can lead to maximum operating pressure ("MOP") and minimum pressure (2.5 bar) problems. These risks are avoided by defining threshold values and the recycling circuit (re-expansion) is utilized to provide a gradual ramp-up and stop the transient.

During a step 58, the automaton receives physical magnitudes captured by the sensors of the backfeeding installation, in particular the pressure value at the inlet of each compressor.

During a step 59, the automaton carries out closed-loop control of the stationary operation of the backfeeding installation, until the compressors are stopped. Then one goes back to step 56 for the next phase of at least one compressor being put into operation.

Figure 7:
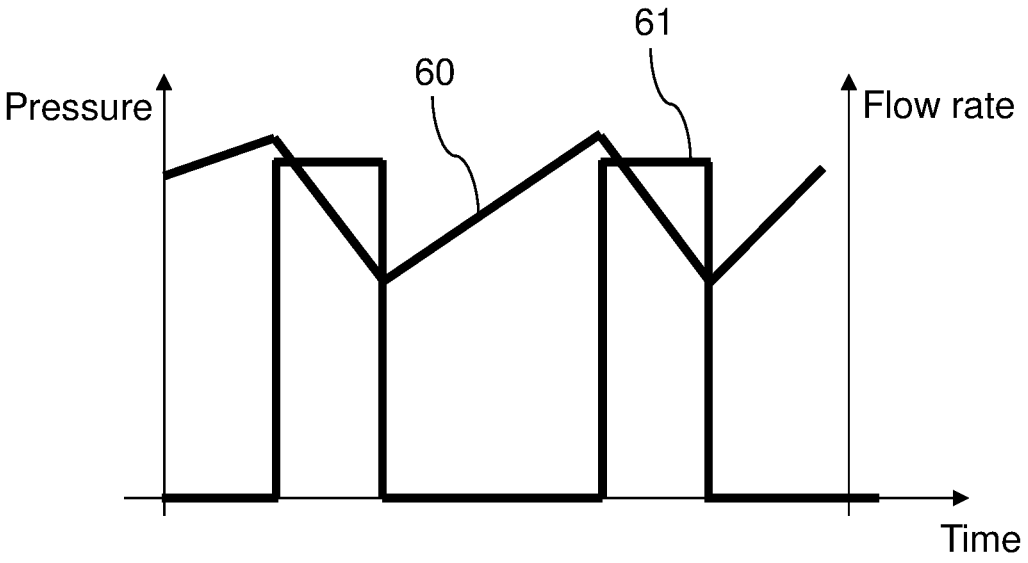
FIG. 7 represents changes in flow rate and pressure during the flow regulation for the backfeeding installation operation.

Two types of regulation envisaged for the compressor are described below. Flow rate regulation means that the flow rate going through the compressor is constant when the unit operates. However, it is the suction pressure (for example in a medium pressure network) which triggers the starting and stopping of the compressor when this pressure reaches threshold values set during step 54. FIG. 7 represents an example of the change in the pressure 60 upstream from the compressor and of the flow rate 61 of the compressor, in a case where the pressure threshold for starting the compressor is 4.2 bar and where the pressure threshold for stopping the compressor is 2.5 bar. When the pressure decreases between these two threshold values during the operation of the compressor, the automaton regulates the operation of the compressor so as to have a constant flow rate of 700 $Nm^3/h$.

Figure 8:
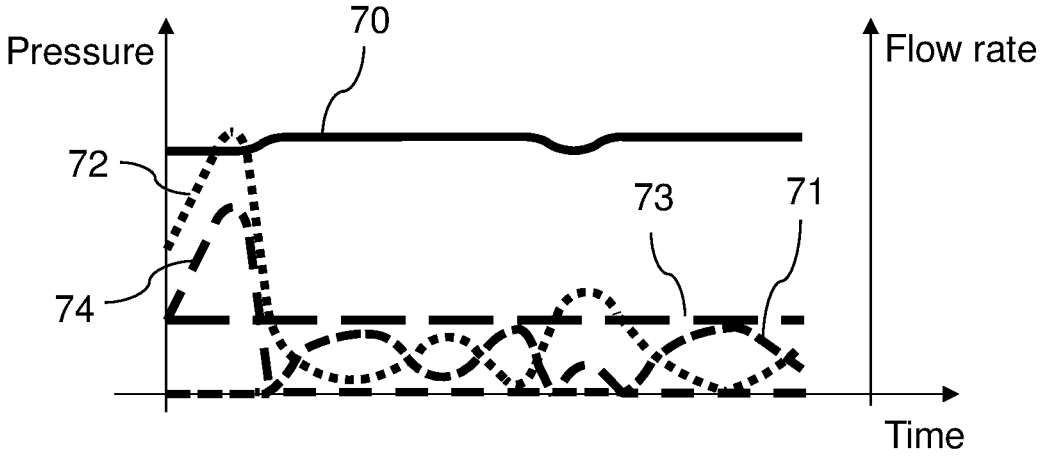
FIG. 8 represents changes in flow rate and pressure during the pressure regulation for the backfeeding installation operation.

In the case of pressure regulation, the flow rate going through the unit evolves so that the suction pressure (for example in a medium pressure network) stays constant. FIG. 8 shows an example of the change in the pressure 70 upstream from the compressor and of the flow rate 71 of the compressor with a pressure setpoint value upstream from the compressor of 4 bar, as a function of the flow rate 72 of the gas consumed by the consumers over the distribution network, of the flow rate 73 of the gas injected by biomethane producers over the distribution network. FIG. 8 also shows the flow rate 74 of gas supplied by the transport network.

FIG. 8 shows that, once the flow rate of the consumption over the distribution network is less than the biomethane injection flow rate, the delivery station stops injecting gas from the transport network and the automaton regulates the compressor so that the pressure of the distribution network is constant regardless of variations in consumption over the distribution network.

Where there are two compressors, a first compressor performs the operation of the backfeeding installation through to its operating limit. If necessary, the automaton orders the operation of a second compressor to supplement the flow rate of gas passing through the backfeeding installation.

The invention claimed is:

1. Backfeeding installation for the reinjection of a gas, from a gas distribution network operating at a first pressure to a gas transport network operating at a second pressure, the installation comprising:

at least one stationary compressor between the gas distribution network and the gas transport network; and a mounting space for at least one additional compressor between the gas distribution network and the gas transport network, which space is equipped with at least one gas inlet connector at the first pressure, at least one gas outlet connector at the second pressure, and at least one energy supply connector for the additional compressor;

a distribution unit for distributing gas from the gas distribution network at the first pressure to each stationary compressor and to the gas inlet connector at the first pressure for at least one additional compressor;

a collection unit for collecting gas from each stationary compressor and the gas outlet connector at the second pressure for each additional compressor; and an automaton configured to detect gas oversupplies in the gas distribution network, to determine the compression capacity of the at least one stationary compressor and said at least one additional compressor, and to control the operation of each stationary compressor and each additional compressor as a function of the compression capacity and to selectively operate said at least one additional compressor in accordance with the gas oversupplies.

2. Installation according to claim 1, wherein the mounting space for at least one additional compressor is configured to accommodate a vehicle containing at least one additional compressor, the installation being configured so that the vehicle has driving access from outside the installation to the mounting space.

3. Backfeeding installation according to claim 1, which also comprises a recycling circuit equipped with a valve, configured to expand the gas exiting from at least one compressor and inject it upstream from or into the distribution unit when at least one compressor is put into operation, the automaton being configured to control the operation of the valve of the recycling circuit as a function of the compression capacity of the operational stationary and additional compressors that are put into operation jointly.

4. Backfeeding installation according to claim 1, wherein at least one additional compressor is mobile.

5. Backfeeding installation according to claim 4, wherein at least one additional compressor is incorporated into a standard container.

6. Backfeeding installation according to claim 4, wherein at least one additional compressor is mounted on a vehicle.

7. Backfeeding installation according to claim 6, wherein at least one additional compressor is actuated mechanically by a motor of the vehicle.

8. Backfeeding installation according to claim 6, wherein at least one additional compressor is supplied with electrical power by a generator mounted on the vehicle.

9. Backfeeding installation according to claim 1, wherein the energy supply connector of the additional compressor supplies gas at the first pressure to a motor or to an electricity generator of a vehicle.

10. Backfeeding installation according to claim 1, wherein the lines and electrical power supplies are sized for the simultaneous operation of each stationary compressor and of each additional compressor.

11. A method for a scalable backfeeding of gas from a gas distribution network operating at a first pressure to a gas transport network operating at a second pressure, the method comprising:

providing between the gas distribution network and the gas transport network at least one stationary compressor between;

installing an automaton configured for detecting gas oversupplies in the gas distribution network and for controlling the operation of each stationary compressor;

providing between the gas distribution network and the gas transport network a mounting space for at least one additional compressor, which space is equipped with at least one gas inlet connector at the first pressure, at least one gas outlet connector at the second pressure, and at least one energy supply connector for the additional compressor;

providing a distribution unit for distributing gas from the gas distribution network at the first pressure to each stationary compressor and to the gas inlet connector at the first pressure for at least one additional compressor;

providing a collection unit for collecting gas from each stationary compressor and the gas outlet connector at the second pressure for each additional compressor;

detecting gas oversupplies in the gas distribution network;

determining the compression capacity of the at least one stationary compressor and said at least one additional compressor; and selectively operating said at least one additional compressor in accordance with the gas oversupplies.

* * * * *